US005647498A

United States Patent [19]

Kaneko

[11] Patent Number: 5,647,498

[45] Date of Patent: Jul. 15, 1997

[54] HINGED CONTAINER CAP

[75] Inventor: Yoshio Kaneko, Kanagawa-ken, Japan

[73] Assignee: Nifco, Incorporated, Yokohama, Japan

[21] Appl. No.: 571,315

[22] Filed: Dec. 12, 1995

[30] Foreign Application Priority Data

Feb. 10, 1995 [JP] Japan ..... 7-046526

[51] Int. Cl.[6] ..... B65D 43/26

[52] U.S. Cl. ..... 220/263; 220/331

[58] Field of Search ..... 220/260, 262–264, 220/329, 331, 334, 338, 340; 215/295, 235, 303; 206/581; 132/293, 295, 300, 301, 304, 305, 315

[56] References Cited

U.S. PATENT DOCUMENTS

| | | | |
|---|---|---|---|
| 2,562,580 | 7/1951 | Satz et al. . | |
| 3,476,123 | 11/1969 | Flax | 132/315 |
| 5,205,402 | 4/1993 | Maeda | 206/250 |
| 5,356,025 | 10/1994 | Renault | 220/263 |

FOREIGN PATENT DOCUMENTS

| | | | |
|---|---|---|---|
| 1-66355 | 4/1989 | Japan . | |
| 83592 | 7/1956 | Netherlands | 220/331 |

*Primary Examiner*—Allan N. Shoap
*Assistant Examiner*—Nathan Newhouse
*Attorney, Agent, or Firm*—Skjerven, Morrill, MacPherson, Franklin & Friel

[57] ABSTRACT

A container cap, comprising a primary cap provided with an outlet opening in a top wall thereof, and fitted to a mouth of a container, a secondary cap hinged to the top wall of the primary cap, and rotatable between a closing position for closing the outlet opening and an opening position for exposing the outlet opening, and a slide member which is axially slidable along the primary cap, and is attached to a point of the secondary cap outside the hinged end thereof via a flexible connecting member. The flexible connecting member may be integrally molded with the secondary cap and the slide member. This container cap can reduce the possibility of inadvertently opening, and prevent the content from sticking to the finger used for operating the secondary cap.

4 Claims, 1 Drawing Sheet

HINGED CONTAINER CAP

TECHNICAL FIELD

The present invention relates to a cap adapted to be fitted to the mouths of containers of food seasonings, medicines, cosmetics and so on, and in particular to a cap that can be opened with a single action.

BACKGROUND OF THE INVENTION

A cap made of synthetic resin material is often fitted to the mouths of the containers of food seasonings, medicines, cosmetics and so on. For instance, Japanese utility model laid-open publication No. 01-66355 discloses a cap comprising a base cap (primary cap) having an outlet opening in the top wall thereof, a lid member (secondary cap) hinged to the base cap via a reversing hinge, and a slidable plate member slidably engaged to the upper surface of the base cap and provided with a ramp portion for pushing up the lid member and a projection that can engage the inner surface of the reversing hinge so that the lid member can be opened up with a single action simply by sliding the plate member.

According to this previously proposed structure, because an end portion of the plate member for opening up the lid member projects laterally, and the lid member can be opened up by pushing this projecting end of the plate member inward, it is possible that the lid member may be inadvertently opened up by the projecting end of the plate member being pushed while the container is being carded. Also, because the opening end of the lid member and the operating end of the plate member are located on the same side, the content of the container may stick to the finger when the content is dispensed.

BRIEF SUMMARY OF THE INVENTION

In view of such problems of the prior art, a primary object of the present invention is to provide an improved container cap which can be opened up with a single action, but has reduced possibility of inadvertently opening up by any unintended external force.

A second object of the present invention is to provide a container cap which can be opened up with a single action, but can prevent the content of the container from sticking to the finger used for opening the cap.

A third object of the present invention is to provide a container cap which can be opened up with a single action, and can be easily and inexpensively molded from synthetic material.

According to the present invention, these and other objects can be accomplished by providing a container cap, comprising: a primary cap provided with an outlet opening in a top wall thereof, and fitted to a mouth of a container; a secondary cap having an end hinged to the top wall of the primary cap, and rotatable between a closing position for closing the outlet opening and an opening position for exposing the outlet opening; and a slide member which is engaged to an outer circumferential surface of the primary cap so as to be axially slidable, and is attached to a point of the secondary cap which is outside the hinged end thereof via a flexible connecting member. Preferably, the flexible connecting member is integrally molded with the secondary cap and the slide member.

Because the opening operation for the primary cap consists of the movement along the outer circumferential surface of the primary cap, the possibility of inadvertently opening the secondary cap can be substantially reduced. It is also possible to place the side from which the secondary cap is operated and the opening side of the secondary cap may be placed on the opposite sides of the primary cap.

According to a preferred embodiment of the present invention, the secondary cap is integrally provided with a plug which fits into the outlet opening when the secondary cap is at the closing position so that the outlet opening may be securely closed, and the content of the container may be prevented from spillage in a reliable fashion.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
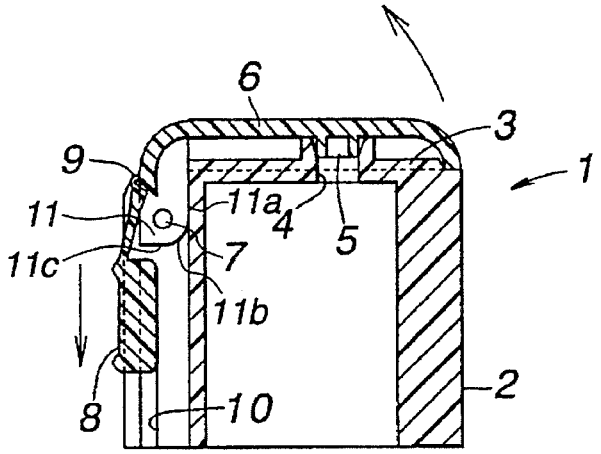
FIG. 1 is a longitudinal sectional view of the container cap according to the present invention when the secondary cap is fully closed.
Figure 2:
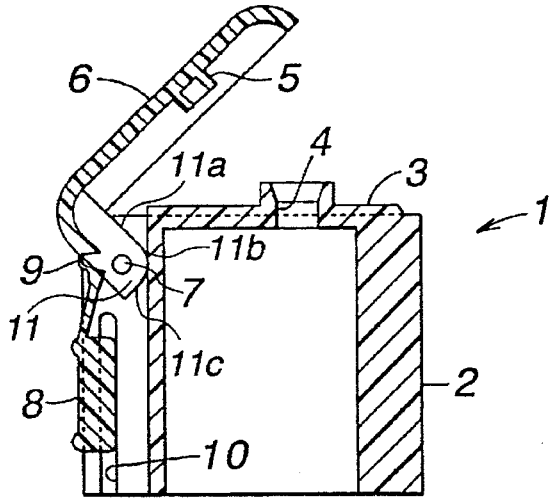
FIG. 2 is a longitudinal sectional view of the container cap of FIG. 1 when the secondary cap is being opened.
Figure 3:
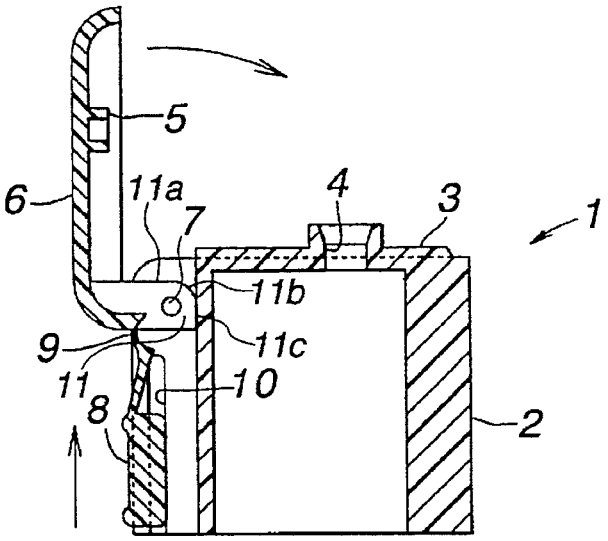
FIG. 3 is a longitudinal sectional view of the container cap of FIG. 1 when the secondary cap is fully opened.

FIGS. 1 to 3 show a container cap constructed according to the present invention. The cap 1 consists of a primary cap 2 which is substantially cup shaped and fitted to the mouth of a container main body (not shown in the drawings), and a secondary cap 6 which is provided with a plug 5 on an inner surface thereof adapted to be fitted into an outlet opening 4 provided in a top wall 3 of the primary cap 2. Each of them is injection molded with a plastic material such as polypropylene having a suitable resiliency.

The secondary cap 6, having the shape of a shallow dish, is supported, at a peripheral part thereof, by a peripheral outer surface adjacent to the top wall 3 of the primary cap 2 via a pin shaft 7 so that the secondary cap can rotate between a closing position for covering the top wall 3 of the primary cap 2 as illustrated in FIG. 1, and an opening position for exposing the outlet opening 4 as illustrated in FIG. 3.

Secondary cap 6 has a pivot 11 comprised of a first flat part 11*a* and second flat part 11*c* and an intermediate curved part 11*b*. When secondary cap 6 is in a closing position as illustrated in FIG. 1, the first flat part 11*a* is flush against the outer wall of primary cap 2 to prevent secondary cap 6 from inadvertently opening. When secondary cap 6 is in an opening position as illustrated in FIG. 3, the second flat part 11*c* is flush against the outer wall of primary cap 2 to prevent secondary cap 2 from inadvertently closing. While secondary cap 2 is rotating between an opening and a closing position, intermediate curved part 11*b* contacts the outer wall of primary cap 2 as illustrated in FIG. 2.

The secondary cap 6 is integrally molded with a slide member 8 for applying an opening/closing force to the secondary cap 6. The slide member 8 is attached to a peripheral part of the secondary cap 6 via a flexible thin connecting member 9, and is axially slidable by being engaged with a guide slot 10 provided on the outer circumferential surface of the primary cap 2 along the axial direction thereof. The connecting member 9 is similar to what is generally called as a plastic hinge, and consists of a thin segment which is integrally molded with the secondary cap 6 and the slide member 8.

The operation of this embodiment is now described in the following. When the secondary cap 6 is closed, the tip of the plug 5 projecting from the inner surface of the secondary cap 6 fits into the outlet opening 4 of the primary cap 2, thereby stopping the content from being dispensed from the container (see FIG. 1). When the slide member 8 is pulled down from this condition, the outer peripheral part of the secondary cap 6 hanging over outward from the pin shaft 7 is pulled down via the connecting member 9 so that the opening end of the secondary cap 6 remote from the pin shaft 7 is lifted around the pin shaft 7 (see FIG. 3). As the slide member 8 is further pulled down, the secondary cap 6 is fully opened, and the outlet opening 4 in the top wall 3 of the primary cap 2 is exposed (see FIG. 3).

When closing the secondary cap 6, the slide member 8 is pushed up along the outer circumferential surface of the primary cap 2 so that the secondary cap 6 is rotated or tilted in the opposite direction, and the secondary cap 6 is pushed against the primary cap 2 until the plug 5 is fitted into the outlet opening 4 and the closed condition illustrated in FIG. 1 is achieved.

According to the present invention, because the part projecting from the outer surface is minimized, it is possible to substantially reduce the possibility of inadvertently opening the cap. Therefore, the possibility of inadvertently spilling the content of the container can be minimized. Because the side from which the secondary cap is operated and the opening side of the secondary cap can be placed opposite to each other, and the outlet opening for the content is therefore placed remote from the finger for operating the secondary cap, it is possible to reduce the possibility of the content of the container sticking to the finger.

Although the present invention has been described in terms of a preferred embodiment thereof, it is obvious to a person skilled in the art that various alterations and modifications are possible without departing from the scope of the present invention which is set forth in the appended claims.

What I claim is:

1. A container cap, comprising:

a primary cap provided with an outer surface and an outlet opening in a top wall thereof, said primary cap being adapted to be fitted to a mouth of a container;

a secondary cap having an end hingedly attached to the outer surface of said primary cap, and rotatable about a pivot between a closing position for closing said outlet opening and an opening position for exposing said outlet opening;

a non-rotating slide member slidably engaged to an outer circumferential surface of said primary cap and attached to an outer peripheral point of said secondary cap via a flexible connecting member, wherein an outer surface of said slide member is exposed on said outer circumferential surface of said primary cap; and wherein the slide member is manually pulled down axially and linearly to open said outlet opening and manually pushed up axially and linearly to close said outlet opening.

2. A container cap according to claim 1, wherein said primary cap includes a straight slot and said flexible connecting member is an integrally molded connection between said secondary cap and said slide member; and wherein said slide member slides in the straight slot in said primary cap.

3. A container cap according to claim 1, wherein said secondary cap is integrally provided with a plug which fits into said outlet opening when said secondary cap is at said closing position.

4. A container cap according to claim 1, wherein said pivot comprising: a first flat surface, a second flat surface and an intermediate curved surface.

* * * * *